US007762247B2

(12) United States Patent
Evans

(10) Patent No.: US 7,762,247 B2
(45) Date of Patent: Jul. 27, 2010

(54) PAINTBALL GUN AND FIRING ASSEMBLY

(76) Inventor: Edward M. Evans, 697 The Glen Road, Woodville, Ontario (CA) K0M 2T0

( * ) Notice: Subject to any disclaimer, the term of this patent is extended or adjusted under 35 U.S.C. 154(b) by 498 days.

(21) Appl. No.: 11/858,369

(22) Filed: Sep. 20, 2007

(65) Prior Publication Data

US 2008/0066729 A1 Mar. 20, 2008

Related U.S. Application Data

(60) Provisional application No. 60/826,299, filed on Sep. 20, 2006.

(51) Int. Cl.
*F41B 11/00* (2006.01)

(52) U.S. Cl. ..... 124/73; 124/31; 124/32

(58) Field of Classification Search ..... 124/31, 124/32, 71–77
See application file for complete search history.

(56) References Cited

U.S. PATENT DOCUMENTS 5,383,442 A * 1/1995 Tippmann ..... 124/76
6,601,780 B1 * 8/2003 Sheng ..... 239/337
7,509,953 B2 * 3/2009 Wood ..... 124/73
7,527,049 B2 * 5/2009 Sheng ..... 124/73
7,591,262 B2 * 9/2009 Jones et al. ..... 124/77
7,640,925 B2 * 1/2010 Jones ..... 124/73
2003/0005918 A1 * 1/2003 Jones ..... 124/70
2005/0115554 A1 * 6/2005 Jones ..... 124/74
2007/0028909 A1 * 2/2007 Wood ..... 124/73
2007/0209650 A1 * 9/2007 Jones ..... 124/73
2009/0095271 A1 * 4/2009 Jones ..... 124/77

* cited by examiner

*Primary Examiner*—Troy Chambers
(74) *Attorney, Agent, or Firm*—Daryl W. Schnurr

(57) ABSTRACT

A firing assembly for a paintball gun has a dynamic piston assembly that moves forward relative to a stationary guide assembly as the gun is being fired. The piston assembly contains a compressed gas storage compartment located entirely within the piston assembly. As the gun fires, air from the gas storage compartment blows into a breech to propel the paintball forward from the breech.

18 Claims, 8 Drawing Sheets

RESTING POSITION

RESTING POSITION

FIRING POSITION

SECTION C-C

SECTION D-D

PAINTBALL GUN AND FIRING ASSEMBLY

Applicant claims the benefit of U.S. Provisional Application Ser. No. 60/826,299 filed on Sep. 20, 2006.

BACKGROUND OF THE INVENTION

1. Field of the Invention

This invention relates to pneumatic paintball guns, also known as markers, and to a firing assembly for a paintball gun.

2. Description of the Prior Art

Paintball guns are known and are operable by a compressed gas supply. In the Jones U.S. Pat. No. 6,644,295 issued Nov. 11, 2003, there is described a pneumatic assembly for a paintball gun and a paintball gun having a gas storage area located outside of a firing valve and outside of the bolt. The firing valve is seated to seal off the compressed air in the air storage area from entering the releasing port. The bolt shifts rearward and the firing valve 16 moves back to unseat the sealing member from the releasing port 21*a* and compressed gas from the storage area enters the releasing port. In Jones US Patent Application published as 2005/0115550 on Jun. 2, 2005, there is described a paintball gun and a pneumatic assembly for a paintball gun in which a compressed air storage area is located outside of a bolt wall. When the bolt is open, compressed gas is prevented from passing through the bolt ports into the bolt. When the bolt is closed, compressed gas from the storage chamber located outside the bolt is permitted to flow through the bolt ports into the bolt. Even if the bolt is controlled, a pneumatic piston and movement of the pneumatic piston is controlled by a mechanical or electrical pneumatic valve. As the bolt moves forward toward a firing position, a paintball is loaded into the barrel. As the bolt ports slide past the sealing member, compressed gas flows through the bolt ports into the bolt to launch the paintball.

There is a constant quest in the paintball industry to design paintball guns that are smaller and lighter than previous guns in order to increase the ability and agility of the paintball players and also to make it less likely that a particular player is hit by a paintball from an opposing player as a hit on the paintball gun counts as a hit to the player. Previous guns have the compressed gas storage area located outside of the bolt that moves forward or back to open up access between a compressed air storage located outside of the bolt and an interior of the bolt. In those previous paintball guns that have compressed gas storage area that surrounds the bolt, the body of the gun must be large enough to house both the bolt and the storage area and is therefore much larger than the cross-sectional area of the bolt alone.

In U.S. Pat. No. 5,613,483 issued to Lukas et al on Mar. 25, 1997, there is a complex series of air passages and storage chambers located outside of the piston that require a large housing for the gun to enclose the passages and chambers as well as the firing mechanism.

SUMMARY OF THE INVENTION

It is an object of the present invention to provide a paintball gun having a body that houses a piston assembly slidably mounted on a stationary guide assembly in order to fire a paintball where the compressed gas storage area is located within the piston assembly and the stationary guide assembly. It is a further object of the present invention to provide a paintball gun where the number of seals between the piston assembly and the stationary guide assembly is kept to a minimum and preferably does not exceed three. It is still a further object of the present invention to provide a paintball gun and firing assembly for a paintball gun whereby compressed gas is stored in a storage compartment located within a piston assembly, the storage compartment being sealed off from a breech from which a paintball is launched, when compressed gas from the storage area is allowed to enter the breech upon movement of the piston assembly. It is still a further object of the present invention to provide a paintball gun in which a piston return mechanism is housed in a bore located within the trigger frame in order to simplify portray and to minimize the size of the body.

A firing assembly for a paintball gun comprises a dynamic piston assembly slidably mounted on a stationary guide assembly. The dynamic piston assembly has a load position and a firing position. The dynamic piston assembly has a compressed gas storage compartment therein that is configured to receive compressed gas from a compressed gas supply when the piston assembly is in the load position. The paintball gun has a breech for receiving a paintball to be fired, the breech being sealed from the gas storage compartment when the piston is in the load position with the paintball in the breech. A dynamic piston assembly slides forward relative to the stationary guide assembly to the firing position when the gun is about to fire thereby simultaneously allowing compressed gas to pass from the storage compartment to the breech to propel the paintball from the breech.

A firing assembly for a paintball gun comprises a piston assembly slidably mounted on a stationary guide assembly, the piston assembly having a rest position and a firing position. The piston assembly has a compressed gas storage compartment therein that is configured to receive compressed gas from a compressed gas supply when the piston assembly is in a rest position. The paintball gun has a breech for receiving a paintball to be fired, the breech being separated longitudinally from the storage compartment when the piston assembly is in the rest position with the paintball in the breech. The piston assembly slides forward relative to the stationary guide assembly to the firing position when the assembly is activated thereby allowing compressed gas to flow from the storage compartment longitudinally to the breech and to propel the paintball forward longitudinally out of the breech.

A firing assembly for a paintball gun comprises a piston assembly slidably mounted on a stationary guide assembly, the piston assembly having a rest position and a firing position. The piston assembly has a compressed gas storage compartment located therein. The storage compartment is configured to receive compressed gas from a compressed gas supply when the piston assembly is in the rest position. The paintball gun has a breech for receiving a paintball to be fired, the breech being sealed off from the storage compartment when the piston assembly is in the rest position. When a paintball is in the breech and the piston assembly is sliding forward relative to the guide assembly to the firing position, the compressed gas has access to the breech and flows from the storage compartment into the breech to propel the paintball forward. The breech has an inside diameter sized to receive and propel the paintball, the compressed air storage compartment having an inside diameter that is substantially the same as the inside diameter of the breech.

A paintball gun comprises a firing assembly, the firing assembly having a dynamic piston assembly slidably mounted on a stationary guide assembly. A dynamic piston assembly has a load position and a firing position. The dynamic piston assembly has a compressed gas storage compartment that is configured to receive compressed gas from a compressed gas supply when the piston assembly is in the load position. The paintball gun has a breech for receiving a paintball to be fired, the breech being sealed from the gas storage compartment when the piston assembly is in the load position with a paintball in the breech. The dynamic piston assembly slides forward relative to the stationary guide assembly to the firing position, thereby simultaneously allowing compressed gas to pass out of the piston assembly to the breech to propel the paintball forward from the breech.

DETAILED DESCRIPTION OF A PREFERRED EMBODIMENT

Figure 1:
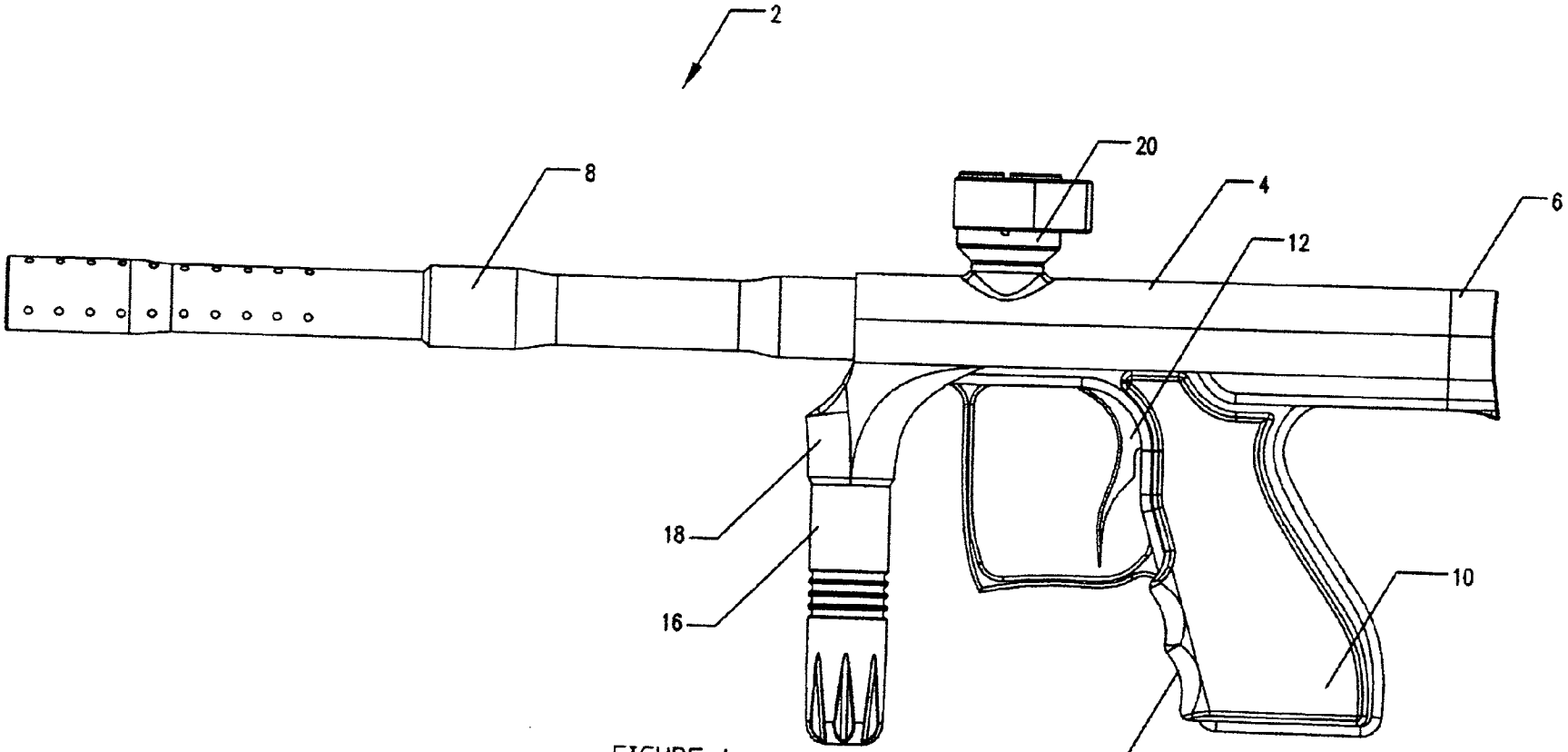
FIG. 1 is a side view of a paintball gun.

In FIG. 1, paintball gun 2 has a body 4 with a backblock 6 at a rear thereof and a barrel 8 extending outward from a front of said body 4. A grip 10 has a trigger 12 and trigger frame 14 connected thereto. The trigger frame 14 is connected to a lower edge of the body 4. A compressed gas regulator 16 has an air source adapter 18 thereon and is connected to the lower edge body 4 at a front thereof. A feed neck 20 is connected at a top of the body 4 near the front thereof. The feed neck is conventional and is capable of receiving a plurality of paintballs which it automatically feeds into a breech, one at a time in succession, as the gun 2 is fired. The breech is not shown in FIG. 1. A compressed gas cylinder (not shown) is connected to the bottom of the trigger frame and has a hose (not shown) extending in to the bottom of the regulator 16.

Figure 2A:
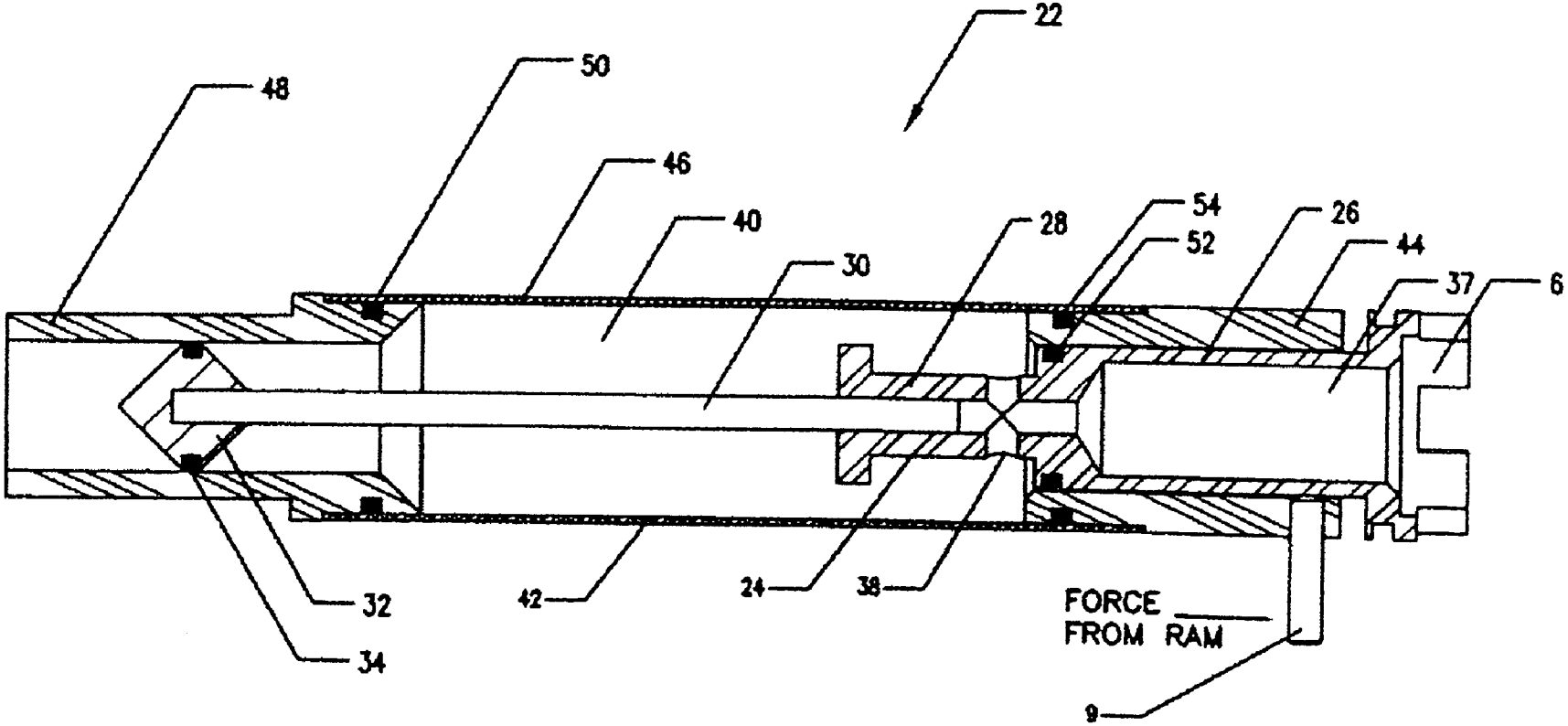
FIG. 2A is a sectional side view of a firing assembly of a paintball gun in a rest position.
Figure 2B:
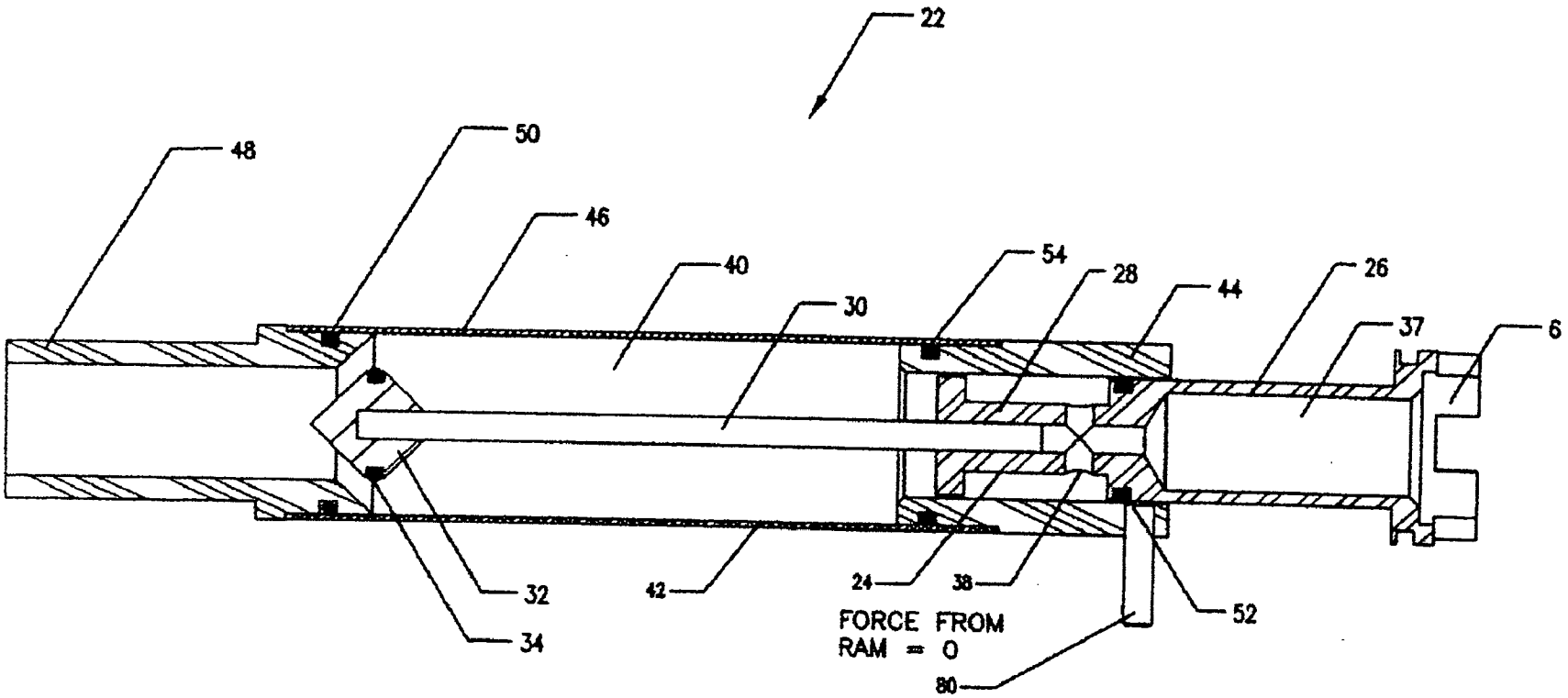
FIG. 2B is a sectional side view of the firing assembly in a firing position.

In FIGS. 2A and 2B, there is shown a sectional side view of a firing assembly 22 in a rest position and in a firing position respectively. The firing assembly 22 is located in the body 4 (not shown in FIGS. 2A and 2B). In FIG. 2A, the firing assembly 22 has the backblock 6 for receiving a compressed gas supply (not shown in FIG. 2A). The stationary guide assembly 24 has a housing 26, with a support 28 located at the front thereof. The support 28 has a hollow center to receive a rod 30, which extends forward to a plug 32 having a seal 34 surrounding an outer edge thereof. The plug 32 is larger than the rod 30 and is located at a free end of the stationary guide assembly 24. The backblock 6 is located at the rear of the housing 26. The compressed gas supply is preferably compressed air. Compressed air from the backblock 6 passes through a passage 37 in the housing 26 and through openings 38 in the support 24. Compressed air can therefore flow from the compressed air cylinder (not shown) through the backblock 6, into the air passage 37 within the housing 26 and through the openings 38 into a firing chamber 40. The compressed air within the firing chamber 40 is prevented from exiting the chamber by the seal 34. Surrounding the stationary guide assembly 24 is a dynamic piston assembly 42. The dynamic piston assembly 42 has a rear cylindrical portion 44, a firing chamber 46 attached to a front of the cylindrical portion 44 and a piston front 48 attached to a front of the firing chamber 46. The piston assembly 42 is slidably mounted relative to the stationary guide assembly 24. The piston assembly is preferably constructed as one-piece. In other words, the cylindrical portion 44, the firing chamber 46 and the piston front 48 are preferably integral components. The stationary guide assembly is also preferably constructed as one piece.

In the rest position, a paintball (not shown) will be inserted into the breech (not shown in FIGS. 2A and 2B). As the trigger is pulled to fire the gun (not shown in FIGS. 2A and 2B), the piston assembly 42 slides forward relative to the stationary guide assembly 24 as shown in 2B. The same reference numerals are used in FIG. 2B as those used in FIG. 2A for those components that are identical. By comparing FIG. 2B with FIG. 2A, it can be seen that the seal 34 is located outside the piston front 48 in FIG. 2B. Also, the air supply from the cylinder (not shown) is cut off from the firing chamber 40, but air from the firing chamber 40 can flow around the seal 34 into the piston front 48, thereby propelling the paintball from the breech and from the gun (not shown in FIGS. 2A and 2B). The breech (not shown in FIGS. 2A and 2B) is located in front of the piston front. The firing chamber 46 is a compressed gas storage compartment and has an inside diameter that is slightly larger than an outside diameter of the piston front 48. Since the inside diameter of the piston front 48 is less than the inside diameter of the cylindrical portion 44, the pressure on the piston front is greater than the pressure on the cylindrical portion 44. Therefore, the piston assembly 42 moves forward relative to the stationary guide assembly 24. The cylindrical portion 44, the firing chamber 40 and the piston front 48 are preferably press-fit together. In FIGS. 2A and 2B, it can be seen that the firing assembly has four seals 34, 50, 52, and 54. When the piston assembly and the stationary guide assembly are each made of one piece, the seals 50 and 54 can be eliminated.

Figure 3A:
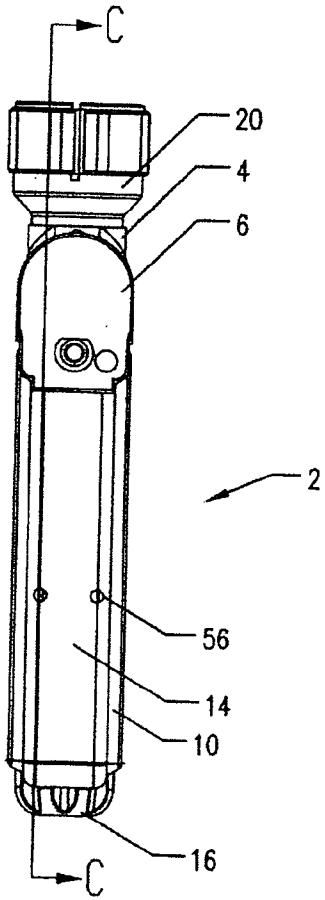
FIG. 3A is a rear view of the paintball gun shown in FIG. 3A.

In FIG. 3A, there is shown a rear view of the paintball gun 2. The same reference numerals are used in FIGS. 3A, 3B, 3C and 3D as those used in FIGS. 1, 2A and 2B. FIG. 3A is a rear view of the paintball gun 2 with a trigger frame 14 extending downward from the body 4. When the seal 34 loses contact with the inner surface of the piston front 48, the air within the storage compartment expands to propel the paintball from the breech (not shown in FIGS. 2A and 2B).

Figure 3B:
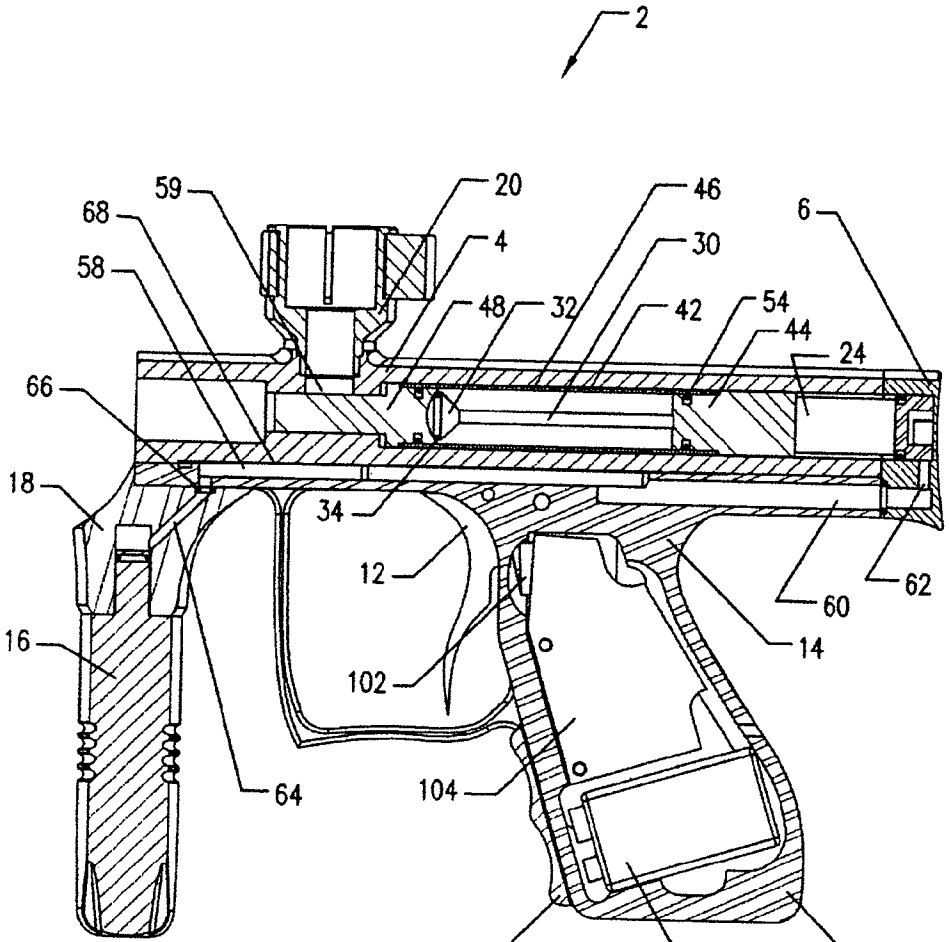
FIG. 3B is a sectional side view of a further embodiment of a firing assembly of a paintball gun with a handle and trigger thereon.

In FIG. 3B, which is a sectional view along the lines C-C of FIG. 3A, the firing assembly 22 is shown in the firing position of FIG. 2B. In the firing position, the piston assembly 42 has moved forward relative to the stationary guide assembly 24. A groove 58 in a top of the trigger frame 14 connects to a passage 60 extending longitudinally in the rear of the trigger frame 14 to a vertical passage 62 which is connected to the backblock 6. An air passage 64 is located in the regulator 16 and connects into a short passage 66, which in turn is connected to the groove 58. Air pressure from the regulator 16 can thus be transferred to the backblock 6 through the air passages 64, 56, the groove 58, the air passage 60 and the vertical passage 62. A gasket 68 extends along the top of the groove 58 between the trigger frame 14 and the body 4 to seal the mating surfaces between the body 4 and the trigger frame 14 and prevent air within the groove 58 from escaping from the gun 2.

Figure 3D:
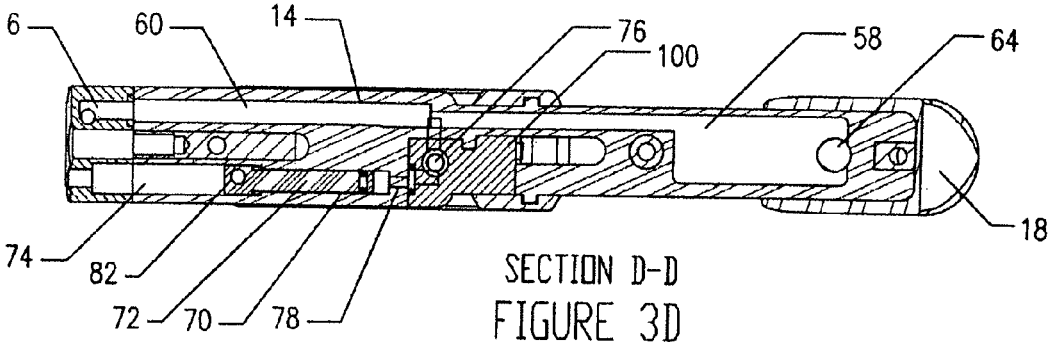
FIG. 3D is a sectional view through the section D-D of FIG. 3C of that part of the firing assembly.
Figure 3C:
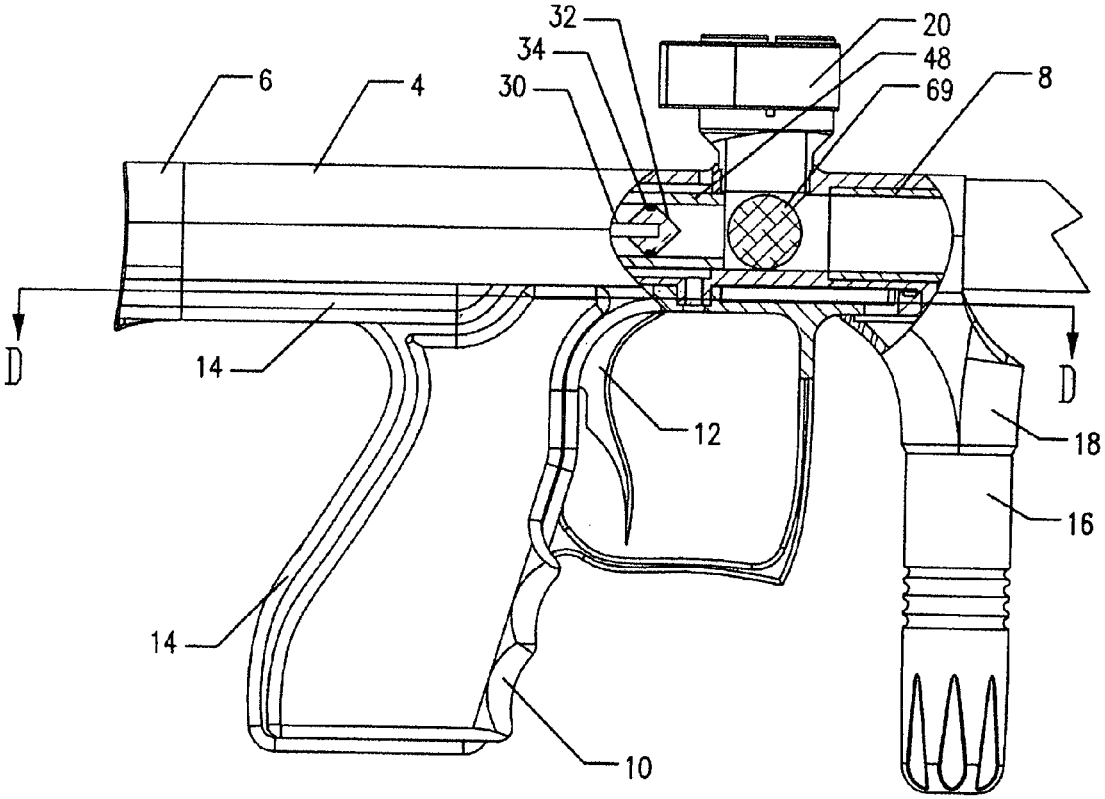
FIG. 3C is a side view of an opposite side of the paintball gun shown in FIG. 3A.

In FIG. 3C, there is shown a side view of the gun 2 with the barrel omitted. As soon as the gun 2 returns to the rest position after firing, a paintball 69 falls from the feed neck 20 into a breech 59 located beneath the feed neck 20. The piston front 48 extends into the breech 59 when the piston assembly moves forward upon firing. The body 4 is partially cut away to expose the breech 59, part of an inside of the barrel 8 and the piston front 48. The breech 59 contains a paintball 69. FIG. 3D is a sectional top view of the trigger frame 14 along the section D-D of FIG. 3C. The same reference numerals are used in FIGS. 3C and 3D as those used in FIGS. 3A and 3B for those components that are identical. On a side of a trigger frame 14 opposite to the passage 60 is a piston return mechanism 70. A ram 72 is housed in a bore 74 located in the trigger frame 14. A control valve 76 allows air pressure to pass through a passage 78 and to flow into the bore 74. The ram 72 is connected to the piston assembly 42 by a pin 80 (see FIGS. 2A and 2B) which is located in a pin hole 82 in the ram 72. As the ram 72 is forced rearward by the air pressure coming through the passage 78, the piston assembly is forced rearward as well. The piston assembly 42 is not shown in FIG. 3D. The pin 80 is not shown in FIGS. 3A to 3D. Returning to FIG. 3B, a battery 84 is located within the trigger frame 14. The battery is connected to power the control valve 76.

Figure 4A:
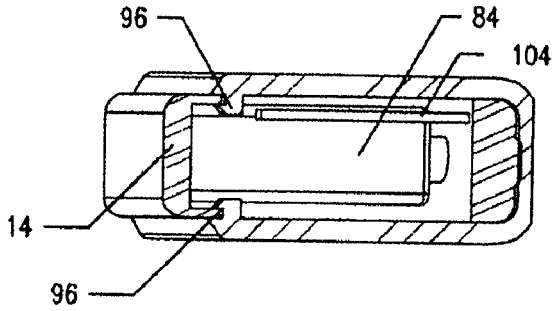
FIG. 4A is a partial side view of a handle and trigger portions of the paintball gun with partially cut away portions.
Figure 4B:
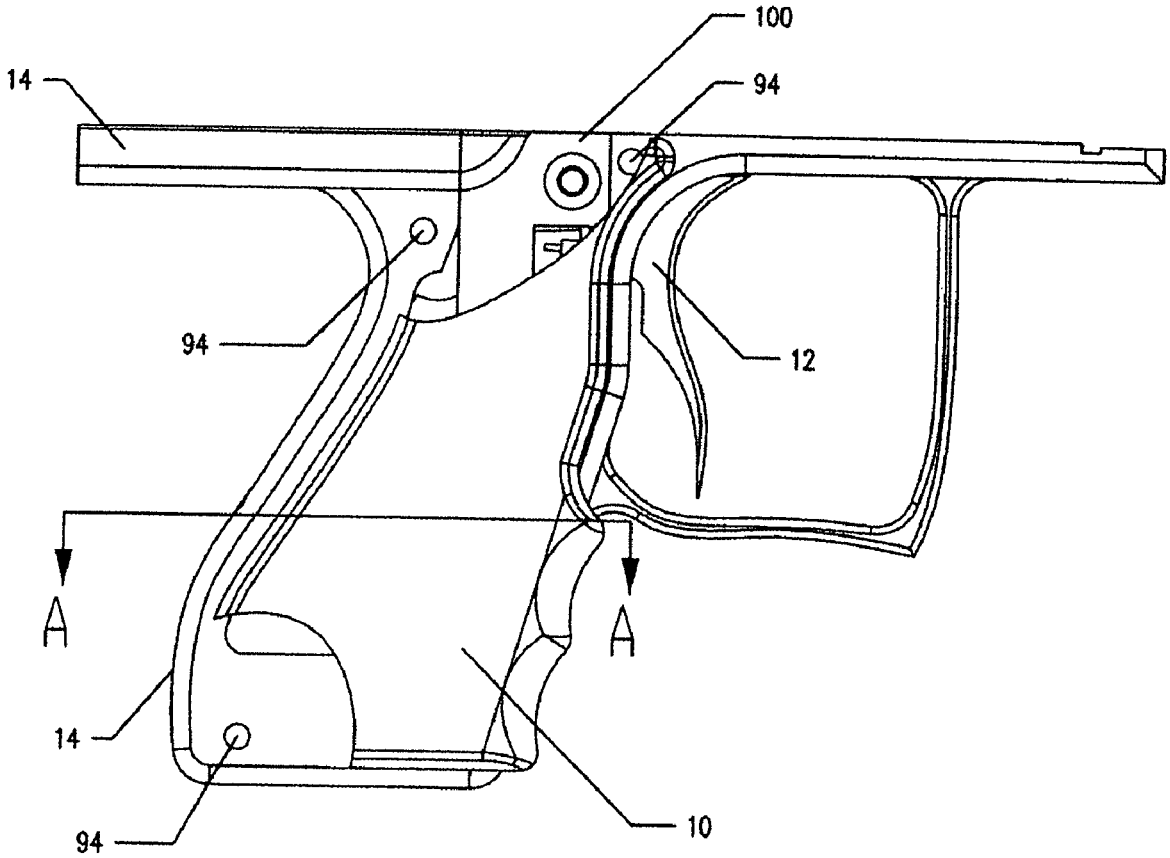
FIG. 4B is a sectional view along the section A-A of FIG. 4A.

In FIG. 4A, there is shown a side view of the trigger frame 14. Grips 10 snap into place on bosses 94 as shown in FIG. 4B. The grips 10 can be removed from the trigger frame 14 by forcing snap tabs 96 from the trigger frame 14 using access holes in the back of the trigger frame 14. The same reference numerals are used in FIGS. 4A and 4B as those used in FIGS. 3A to 3D.

Figure 5A:
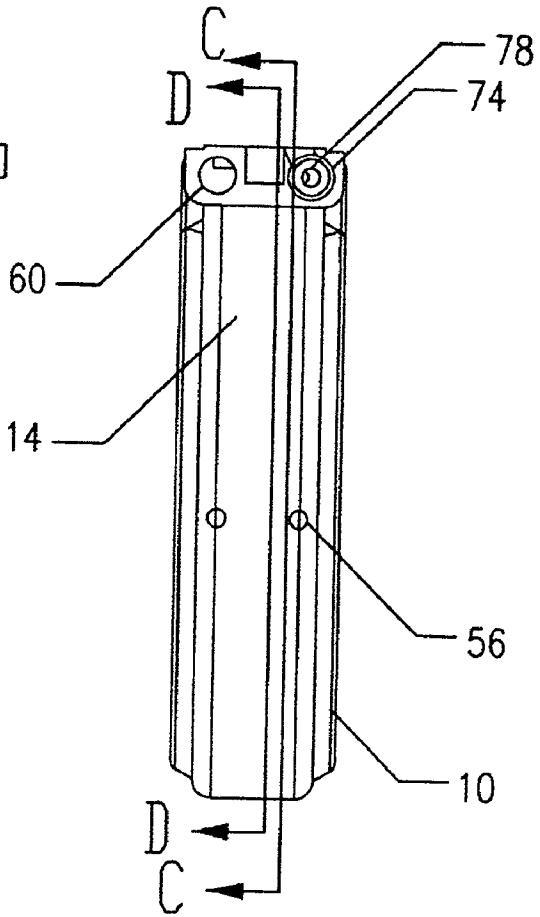
FIG. 5A is a rear view of a handle and trigger portion of the paintball gun.
Figure 5B:
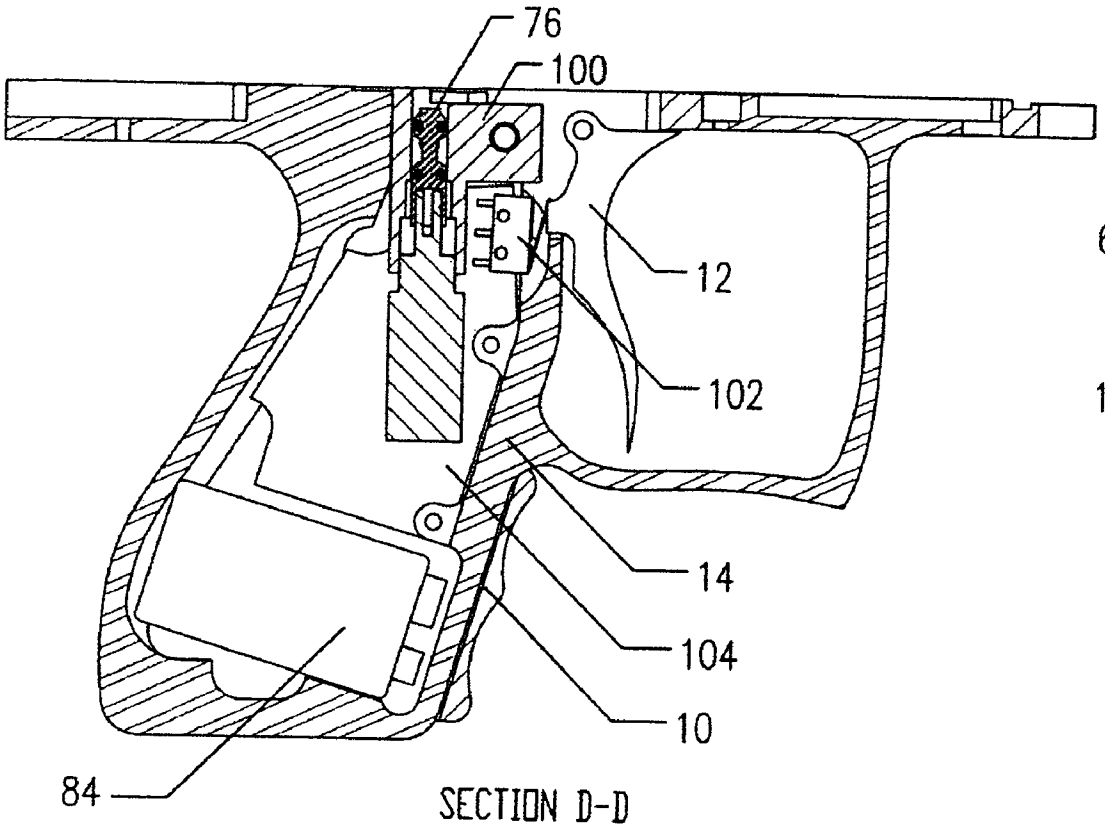
FIG. 5B is a sectional side view along the section D-D of FIG. 5A.
Figure 5C:
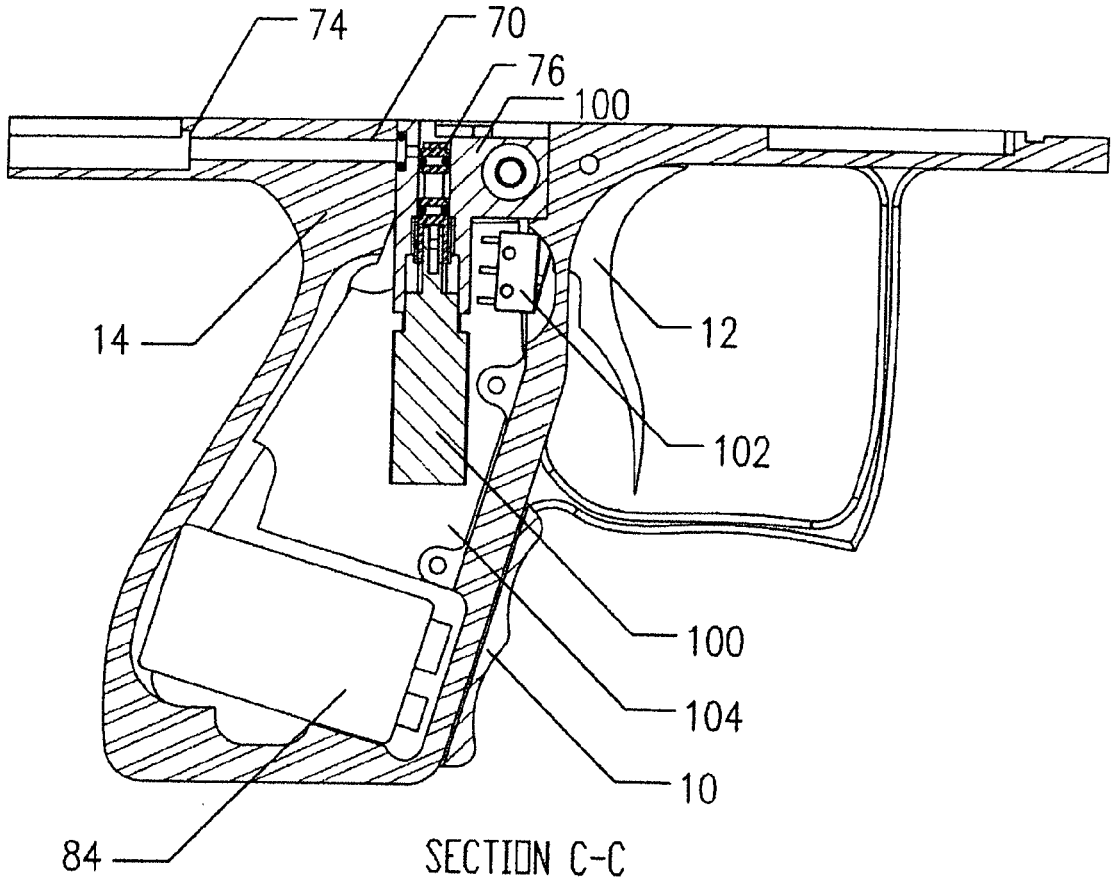
FIG. 5C is a sectional side view along the section C-C of FIG. 5A.

In FIG. 5A, there is shown a rear view of the trigger frame 14. In FIG. 5B, there is shown a sectional side view along the section D-D of FIG. 5A. In FIG. 5C, there is shown a sectional side view along the section C-C of FIG. 5A.

In operation, (referring to all of the Figures), when the piston assembly 42 is in the rest position, a paintball 69 (not shown in FIG. 5A, 5B or 5C) drops into the breech 59 (not shown in FIG. 5A, 5B, or 5C) of the body 4. A mechanical or electrical pneumatic valve 100 (preferably an electronic solenoid valve) initiates the firing of the paintball gun in response to rearward movement of the trigger 12. The trigger activates a microswitch 102 which transmits an electronic signal to a circuit board 104. The circuit board 104 then sends a pulse or a series of pulses depending on the firing mode to actuate the electro-pneumatic valve 100. When activated, the electro-pneumatic valve 100 directs compressed gas through the control valve 76 into the storage compartment 40 within the firing chamber. The air pressure causes the piston assembly 42 to move forward because the cross-sectional area of the piston front 48 is greater than the cross-sectional area of the rear cylindrical portion 44. The piston front 48 preferably contacts the paintball and begins to push the paintball forward, just prior to the air being released. The free end 32 of the stationary guide assembly 24 becomes separated from the piston front 48, thereby allowing the compressed air within the storage compartment 40 to expand and flow forward through the piston front 48 and through the breech to propel the paintball. When the paintball has been fired, the control valve 76 emits air through the passage 78 and into the bore 74 to return the ram 72 to the rearward position, thereby simultaneously returning the piston assembly 42 to the rest position. The gun 2 is then ready for subsequent firing. The method is then repeated for a further firing or firings.

The groove along the top of the trigger frame allows the body to be reduced in size as the air passage is created by the body and trigger frame together and is not located entirely in the body. In addition, the ram and bore located in the trigger frame also allow the body to be reduced in size as the bore is located in the trigger frame rather than in the body. In addition, the compressed air storage compartment is located within the firing chamber and the inside diameter of the firing chamber is substantially the same as the inside diameter of the breech. In the embodiment shown in the drawings, the inside diameter of the firing chamber is slightly larger than the inside diameter of the breech. The breech has an inside diameter slightly larger than a diameter of a paintball. The inside diameter of the firing chamber is therefore substantially equal to the diameter of a paintball. The firing chamber moves forward upon firing of the paintball gun and the compressed gas storage chamber moves forward as well as it is located within the firing chamber. The body can have a much smaller cross-sectional area because the gas storage compartment is located entirely within the piston assembly. The phrase "inside diameter", when used in this herein, means the diameter of the inner surface of the component referred to. The phrase "outside diameter", when used herein, means the diameter of the outer surface of the component referred to.

I claim:

1. A firing assembly for a paintball gun comprising:

a dynamic piston assembly slidably mounted on a stationary guide assembly, said dynamic piston assembly having a load position and a firing position, said dynamic piston assembly having a compressed gas storage compartment therein that is configured to receive compressed gas from a compressed gas supply when said piston assembly is in said load position; said paintball gun having a breech for receiving a paintball to be fired, said breech being sealed from said gas storage compartment when said piston assembly is in said load position with said paintball in said breech; said dynamic piston assembly sliding forward relative to said stationary guide assembly to said firing position when said gun is about to fire, thereby simultaneously allowing compressed gas to pass from said storage compartment to said breech to propel said paintball from said breech.

2. A firing assembly as claimed in claim 1 wherein said gas storage compartment moves forward relative to said stationary guide assembly upon firing of said gun.

3. A firing assembly as claimed in claim 1 wherein said gas storage compartment is located substantially within cylindrical boundary, said boundary having a diameter substantially equal to a diameter of a paintball and having the same longitudinal center axis as said breech and said dynamic piston assembly.

4. A firing assembly as claimed in claim 1 wherein said firing assembly is located within a body and a trigger frame is mounted beneath said body, said trigger frame having a groove extending along a top thereof, said body closing off said groove to form an air passage with said groove between a front of said trigger frame and a rear of said body, there being a connector to receive compressed air located at said rear of said body.

5. A firing assembly as claimed in claim 1 wherein said firing assembly is located within a body, said body having a trigger frame connect along a bottom of said body, said trigger frame having a bore located therein near a top rear of said trigger frame, said bore containing a ram that is slidably mounted in said bore, said ram being connected to said piston assembly, said bore having a control valve located to pass compressed gas into a front of said bore to force said ram rearward after said firing assembly has been moved to the firing position, said control valve thereby returning said piston assembly to said load position.

6. A firing assembly as claimed in claim 3 wherein said piston assembly is constructed as one piece.

7. A firing assembly as claimed in claim 6 wherein said stationary guide assembly is constructed as one piece.

8. A firing assembly for a paintball gun comprising a piston assembly slidably mounted on a stationary guide assembly, said piston assembly having a rest position and a firing position, said piston assembly having a compressed gas storage compartment therein that is configured to receive compressed gas from a compressed gas supply when said piston assembly is in said rest position, said paintball gun having a breech for receiving a paintball to be fired, said breech being separated longitudinally from said storage compartment when said piston assembly is in said rest position with said paintball in said breech, said piston assembly sliding forward relative to said stationary guide assembly to said firing position when said assembly is activated, thereby allowing compressed gas to flow from said storage compartment longitudinally into said breech to propel said paintball forward longitudinally out of said breech.

9. A firing assembly as claimed in claim 8 wherein said piston assembly is moved forward to said firing position by pressure from said compressed gas.

10. A firing assembly as claimed in claim 8 wherein said gas storage compartment is located substantially within a cylindrical boundary, said boundary having a diameter substantially equal to a diameter of a paintball, and having the same longitudinal centre axis as said breech and said dynamic piston assembly.

11. A firing assembly for a paintball gun comprising:

(a) a piston assembly slidably mounted on a stationary guide assembly, said piston assembly having a rest position and a firing position, said piston assembly having a compressed gas storage compartment located therein, said storage compartment being configured to receive compressed gas from a compressed gas supply when said piston assembly is in said rest position, said paintball gun having a breech for receiving a paintball to be fired, said breech being sealed off from said storage compartment when said piston assembly is in a rest position;

(b) when a paintball is in said breech and said piston assembly is sliding forward relative to said guide assembly to said firing position, said compressed gas having access to said breech and flowing from said storage compartment into said breech to propel said paintball forward, said breech having an inside diameter sized to receive and propel said paintball, said compressed air storage compartment having an inside diameter that is substantially the same as an inside diameter of said breech.

12. A firing assembly as claimed in claim 11 wherein said gas storage compartment is located substantially within a cylindrical boundary, said boundary having a diameter substantially equal to a diameter of a paintball, and having the same longitudinal centre axis as said breech and said dynamic piston assembly.

13. A paintball gun comprising a firing assembly, said firing assembly having a dynamic piston assembly slidably mounted on a stationary guide assembly, said dynamic piston assembly having a load position and a firing position, said dynamic piston assembly having a compressed gas storage compartment that is configured to receive compressed gas from a compressed gas supply when said piston assembly is in said load position; said paintball gun having a breech for receiving a paintball to be fired, said breech being sealed from said gas storage compartment when said piston assembly is in said load position with a paintball in said breech; said dynamic piston assembly sliding forward relative to said stationary guide assembly to said firing position, thereby simultaneously allowing compressed gas to pass out of said piston assembly to said breech to propel said paintball forward from said breech.

14. A paintball gun as claimed in claim 13, said gas storage compartment is located substantially within a cylindrical boundary, said boundary having a diameter substantially equal to the diameter of a paintball having the same longitudinal centre axis as said breech and said dynamic piston assembly.

15. A paintball gun as claimed in claim 14, wherein said firing assembly is located within a body and a trigger frame is mounted beneath said body, said trigger frame having a groove extending along a top thereof, said body closing off said groove to form an air passage with said groove, between a front of said trigger frame and a rear of said body, there being a connector to receive compressed air located at a rear of said body.

16. A firing assembly as claimed in claim 15, wherein said trigger frame has a bore located therein near a top rear of said trigger frame, said bore containing a ram that is slidably mounted in said bore, said ram being connected to said piston assembly, said bore having a control valve located to pass compressed gas into a front of said bore to force said ram rearward after said firing assembly has been moved to the firing position, said control valve thereby returning said piston assembly to said load position.

17. A paintball gun as claimed in claim 16, wherein said dynamic piston assembly is formed from one piece.

18. A paintball gun as claimed in claim 17, wherein said dynamic piston assembly is formed as one piece.

* * * * *